US010017890B2

(12) United States Patent
Koike et al.

(10) Patent No.: US 10,017,890 B2
(45) Date of Patent: Jul. 10, 2018

(54) SEWING MACHINE AND CONTROL METHOD THEREOF

(71) Applicant: JANOME SEWING MACHINE CO., LTD., Hachioji-shi, Tokyo (JP)

(72) Inventors: Mikio Koike, Ome (JP); Jun Mafune, Kokubunji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 511 days.

(21) Appl. No.: 14/698,202

(22) Filed: Apr. 28, 2015

(65) Prior Publication Data

US 2016/0122929 A1 May 5, 2016

(30) Foreign Application Priority Data

Oct. 29, 2014 (JP) ..... 2014-220714

(51) Int. Cl.

| | |
|---|---|
| ***D05B 3/00*** | (2006.01) |
| ***D05B 19/12*** | (2006.01) |
| ***D05B 47/04*** | (2006.01) |
| ***D05B 69/30*** | (2006.01) |

(52) U.S. Cl.

CPC ..... *D05B 19/12* (2013.01); *D05B 47/04* (2013.01); *D05B 69/30* (2013.01)

(58) Field of Classification Search

CPC ..... D05B 19/02; D05B 69/30; D05B 47/04; D05B 49/00

See application file for complete search history.

(56) References Cited

U.S. PATENT DOCUMENTS

| | | | | |
|---|---|---|---|---|
| 4,967,679 | A * | 11/1990 | Hara | D05B 45/00 112/255 |
| 5,784,990 | A * | 7/1998 | Shimizu | D05B 19/12 112/182 |
| 2007/0095263 | A1* | 5/2007 | Sakuma | D05B 57/14 112/188 |
| 2010/0199899 | A1* | 8/2010 | Sakuma | D05B 1/02 112/170 |

FOREIGN PATENT DOCUMENTS

JP 2008264500 A 11/2008

* cited by examiner

*Primary Examiner* — Nathan Durham

(74) *Attorney, Agent, or Firm* — Nath, Goldberg & Meyer; Jerald L. Meyer

(57) ABSTRACT

A sewing machine includes a thread take-up lever that supplies an upper thread to a needle from a thread supply source, a hook which catches the upper thread inserted in the needle, and which intertwine the upper thread with a lower thread, and a control unit that controlling a hook release phase at which the hook releases the upper thread in such a way that a hook/upper-thread necessary amount that is necessary when the upper thread is intertwined with the lower thread becomes smaller than a thread-take-up-lever/upper-thread supply amount that is supplied by an operation of the thread take-up lever. The control unit controls the hook release phase at a plurality of timings.

4 Claims, 9 Drawing Sheets

SEWING MACHINE AND CONTROL METHOD THEREOF

CROSS-REFERENCE TO RELATED APPLICATION(S)

This application is based upon and claims the benefit of priority from Japan Patent Application No. 2014-220714, filed on Oct. 29, 2014, the entire contents of which are incorporated herein by reference.

FIELD OF THE INVENTION

The present invention relates to a sewing machine that includes a mechanism which adjusts a timing at which a needle and a hook intersect regardless of a position of the needle that moves and swings from side to side.

BACKGROUND

In sewing machines, an upper thread is supplied to a needle from a thread supply source through a thread take-up lever. The thread take-up lever changes the amount of upper thread to be supplied to the needle from the thread supply source. A lower thread is retained in a hook. A needle bar that supports the needle, and the thread take-up lever are driven by an upper shaft, while the hook is driven by a lower shaft. The upper shaft and the lower shaft are coupled through a toothed belt, and thus the thread take-up lever and the needle, and, the hook are mutually operated. Sewing machines catch, through a tip of the hook, a thread loop formed by the upper thread when the needle rises after falling to the needle bottom dead center, and form a stitch by intertwining the upper thread and the lower thread with each other.

More specifically, the hook includes an inner hook that retains therein the lower thread, and an outer hook that catches the upper thread, and performs a rotation movement along with the rotation of the lower shaft. During cycles of forming stitches, through the up-and-down movement of the needle bar, the upper thread inserted in a needle hole passes completely through a cloth, and the thread loop of the upper thread formed below the cloth is caught by the outer hook. The outer hook rotates while catching the upper thread, and the upper thread passes through the inner hook so as to go around the inner hook in conjunction with the motion of the outer thread. According to this operation, the upper thread and the lower thread intersect with each other, and thus a stitch is formed.

When the upper thread goes around the inner hook, the upper thread temporarily needs a length by what corresponds to the outer circumference of the inner hook. This necessary length of the upper thread is called a hook/upper-thread necessary amount, and is supplied by the descending thread take-up lever that is a thread guide for the upper thread. The upper thread supplied by the operation of the thread take-up lever is called a thread-take-up-lever/upper-thread supply amount. It is preferable that, during a sewing operation, the thread-take-up-lever/upper-thread supply amount should be set to be always larger than the hook/upper-thread necessary amount, and thus the upper thread should be slightly loosened. This is because a thread breakage can be suppressed by the loosened upper thread, and stitches can be formed smoothly.

In addition, since sewing machines are provided with a swing mechanism that swings the needle bar in a direction intersecting the cloth feeding direction, the sewing machines are capable of forming zig-zag stitches. When this swing mechanism is controlled to adjust the swing level of the needle bar and the timing thereof, complex sewing, such as a whipstitch, a pattern stitch, or a letter stitch, is realized.

When complex sewing is performed, if the swing of the needle bar becomes large, the position of the needle bar frequently changes. Hence, relative positional relationship between the needle and the hook changes, and the timing at which the needle and the hook are relatively operated changes together with the change in the relative positional relationship. When the change in this timing exceeds the allowable range, it becomes difficult to form a stitch.

Hence, according to conventional sewing machines, the swing level of the needle bar is limited so as to set the change in relative operation of the needle and the hook within a range that enables a formation of a stitch. Alternatively, two idlers that form an idler unit are caused to contact the toothed belt which couples the upper shaft and the lower shaft (see, for example, JP 2008-264500 A). The idler unit is driven in conjunction with the swing of the needle bar in the case of, for example, zig-zag stitches to change the belt length of the toothed belt at the tensioned side, thereby controlling a needle/hook intersecting phase that is the timing at which the needle and the hook are relatively operated. This control corrects the gap in timing of the needle that is linked with the swing of the needle bar, and that of the hook so as to enable a formation of a stitch even if the swing width is wide.

When the needle bar swings in zig-zag stitches, the needle bar is moving from side to side while the outer hook is catching the upper thread. Hence, the upper thread inserted in the needle hole of the needle also moves from side to side. Accordingly, the hook/upper-thread necessary amount increases in accordance with the swing level of the needle. Conversely, since the motion trajectory of the thread take-up lever is always constant, when the hook/upper-thread necessary amount increases in accordance with the swing of the needle bar, a loosened upper thread cannot be ensured sufficiently, and the upper thread is extraordinary tensioned. This sometimes causes an abnormal noise or a thread breakage.

The present invention has been made to address the above-explained problems of the conventional technologies, and it is an objective of the present invention to provide a sewing machine and a control method thereof which can ensure an upper thread to be sufficiently loosened even if a swing level is increased.

SUMMARY OF THE INVENTION

A sewing machine that addresses the above-explained problems includes: a thread take-up lever supplying an upper thread to a needle from a thread supply source; a hook catching the upper thread inserted in the needle, and intertwining the upper thread with a lower thread; and a control unit controlling a hook release phase, at which the hook releases the upper thread, in such a way that a hook/upper-thread necessary amount that is necessary when the upper thread is intertwined with the lower thread becomes smaller than a thread-take-up-lever/upper-thread supply amount that is supplied by an operation of the thread take-up lever, in which the control unit controls the hook release phase at a plurality of timings.

The control unit may control, at a timing before the hook release phase, the hook release phase so as to advance the hook release phase.

The sewing machine may further include: a rotatable upper shaft driving a needle bar that supports the needle, and the thread take-up lever; a rotatable lower shaft driving the hook; an upper-shaft pulley provided at the upper shaft; a lower-shaft pulley provided at the lower shaft; a belt coupling the upper-shaft pulley and the lower-shaft pulley and synchronizing respective rotations; and a belt adjusting mechanism contacting the belt and changing a belt length at a tensioned side where the belt is drawn in, in which the control unit may control and change a timing at which the belt adjusting mechanism changes the belt length at the tensioned side.

The belt adjusting mechanism may include at least one idler contacting the belt at the tensioned side, and the belt length at the tensioned side may be changed by swinging the idler.

The respective aspects explained above may be realized as a control method of a sewing machine.

According to the present invention, there is provided a sewing machine and a control method thereof which can ensure a sufficient loosened upper thread and which can prevent an occurrence of an abnormal noise or a thread breakage since the control unit controls the hook release phase.

DETAILED DESCRIPTION OF THE EMBODIMENTS

1. First Embodiment

[1-1. Structure]

Figure 1:
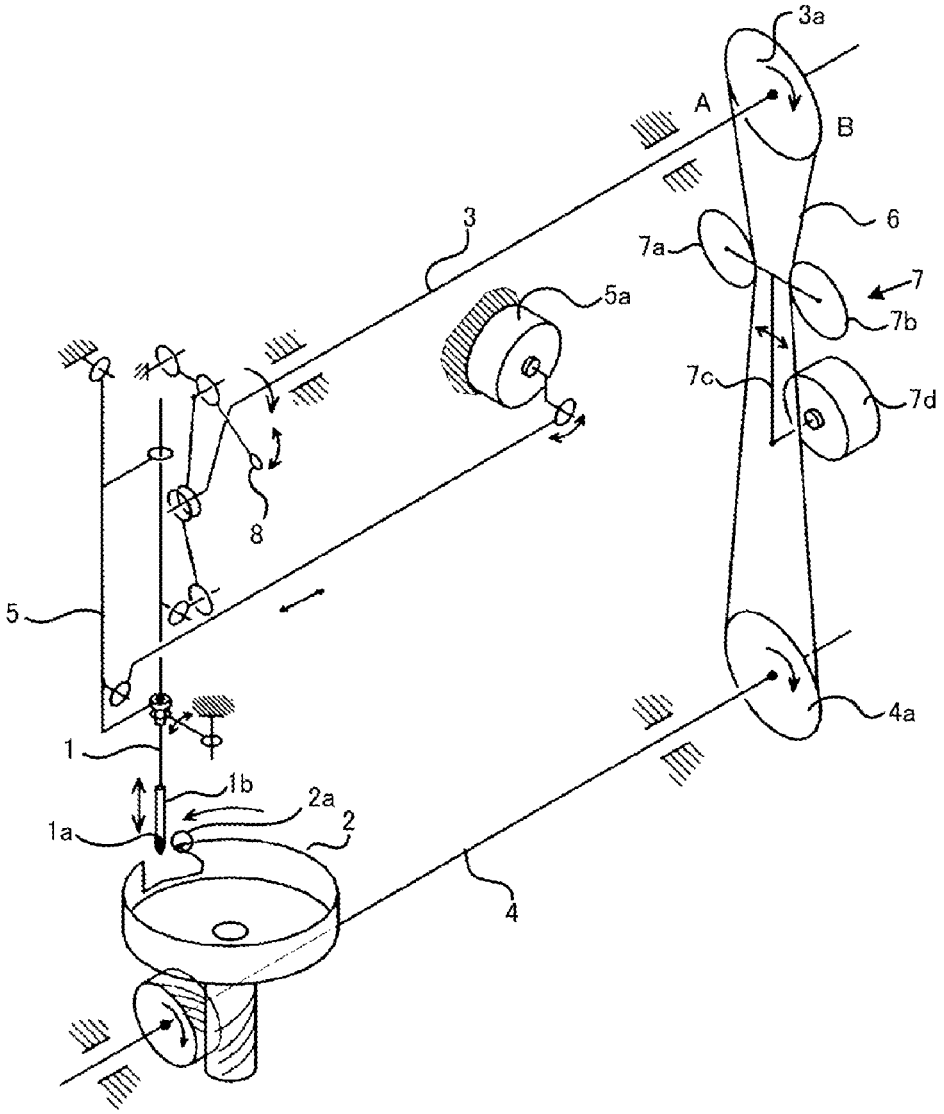
FIG. 1 is an explanatory diagram illustrating an example general structure of a sewing machine according to a first embodiment.

An embodiment of the present disclosure will be explained with reference to the accompanying drawings. In the following explanation, a structure that adjusts a timing at which a needle and a hook in a sewing machine intersect will be mainly explained. The explanation for a detailed structure of a sewing machine will be omitted, but the embodiment of the present disclosure is applicable to all sewing machines available currently or in future like a zig-zag stitching sewing machine. FIG. 1 illustrates an example general structure of a sewing machine of this embodiment.

(1) General Structure

The sewing machine includes a needle bar 1 and a hook. The needle bar 1 supports a needle 1*b* that has a needle hole 1*a* into which an upper thread is inserted. The upper thread is supplied to the needle 1*b* from a thread supply source through a thread take-up lever 8. The thread take-up lever 8 changes the amount of the upper thread to be supplied to the needle 1*b*. The hook includes an unillustrated inner hook that retains therein a bobbin around which a lower thread is wound, and an outer hook 2 that catches the upper thread. The outer hook 2 catches the upper thread through a tip 2*a*.

The sewing machine of this embodiment includes a control unit C that controls a hook release phase, at which the hook releases the upper thread, in such a way that the hook/upper-thread necessary amount becomes smaller than the thread-take-up-lever/upper-thread supply amount. The control unit C controls the hook release phase at plural timings. The hook/upper-thread necessary amount means a necessary amount of upper thread when the upper thread inserted in the needle 1*b* is intertwined with the lower thread retained in the inner hook. The thread-take-up-lever/upper-thread supply amount means an amount of the upper thread to be supplied to the needle 1*b* by the thread take-up lever 8 that operates up and down at a predetermined timing.

(2) Needle/Hook Operation Mechanism

The needle bar 1 and the thread take-up lever 8 are linked with an upper shaft 3 through a crank mechanism. The hook is linked with a lower shaft 4 through a gear mechanism. The upper shaft 3 and the lower shaft 4 are supported rotatably by respective unillustrated bearings fixed in the sewing machine. Drive force from an unillustrated sewing machine motor is transferred to the upper shaft 3.

The crank mechanism of the upper shaft 3 converts the rotation of the upper shaft 3 into a reciprocal motion, thereby moving the needle bar 1 and the thread take-up lever 8 up and down. The upper shaft 3 is provided with a swing mechanism 5 that swings the needle bar 1. When the swing mechanism 5 swings the needle bar 1 with the drive force by a swing motor 5*a* in a direction intersecting with a cloth feeding direction, zig-zag stitches are formed.

The upper shaft 3 is fixed with an upper-shaft pulley 3*a* that has a predetermined number of teeth. In addition, the lower shaft 4 is fixed with a lower-shaft pulley 4*a* that has the same number of teeth as that of the upper-shaft pulley 3*a*. The upper-shaft pulley 3*a* and the lower-shaft pulley 4*a* are coupled with each other through a toothed belt 6. The length of the toothed belt 6 is set so as to produce a predetermined slack when the toothed belt 6 is hung between the upper-shaft pulley 3*a* and the lower-shaft pulley 4*a*.

When the upper shaft 3 rotates, the upper-shaft pulley 3*a* also rotates. This rotation is transferred to the lower-shaft pulley 4*a* through the toothed belt 6, and thus the lower shaft 4 rotates at the same speed as that of the upper shaft 3. The gear mechanism of the lower shaft 4 rotates the hook 2 together with the rotation of the lower shaft 4.

(2) Belt Adjusting Mechanism

A belt adjusting mechanism contacts the toothed belt 6 to adjust the belt length of the toothed belt 6 at the tensioned side A. The belt adjusting mechanism changes the timing of the rotation of the lower shaft 4, thereby correcting a needle/hook intersecting phase that is a timing at which the needle 1*b* and the hook 2 meet each other. In this embodiment, an explanation will be given of an idler unit 7 as an example. The idler unit 7 includes idlers 7*a*, 7*b* that contact the toothed belt 6 at the tensioned side A and a loosened side B, respectively. It is appropriate if the idler unit 7 has at least one idler at the tensioned side A.

In this case, the tensioned side A of the toothed belt 6 means a side where the upper-shaft pulley 3*a* is newly meshed upon rotation of the upper-shaft pulley 3*a*, i.e., a side where the belt is drawn in. In addition, the loosened side B means a side where the upper-shaft pulley 3*a* is disengaged upon rotation of the upper-shaft pulley 3*a*, i.e., a side where the belt is drawn out. In the following explanation, the tensioned side A and the loosen side B are referred to as right and left, respectively in some cases.

The idlers 7*a*, 7*b* are disposed at the tensioned side A and the loosened side B so as to hold the toothed belt 6 therebetween from the outer circumference of the toothed belt 6. The idlers 7*a*, 7*b* are coupled with a motor 7*d* through an arm 7*c*. The idlers 7*a*, 7*b* swing, by the drive force from a motor 7*d*, in accordance with an operation instruction from the control unit C. The motor 7*d* is connected with a motor drive unit 16 to be discussed later. When the idler unit 7 is operated, the slack of the toothed belt 6 is moved to the tensioned side A and the loosened side B. Hence, the belt length of the toothed belt 6 at the tensioned side A is changed in accordance with the swing of the needle bar 1. Accordingly, the timings of the respective rotations of the upper shaft 3 and the lower shaft 4 are controlled, and thus a timing at which the needle 1*b* and a tip 2*a* of the hook 2 meet is adjusted.

(3) Control Unit

Figure 2:
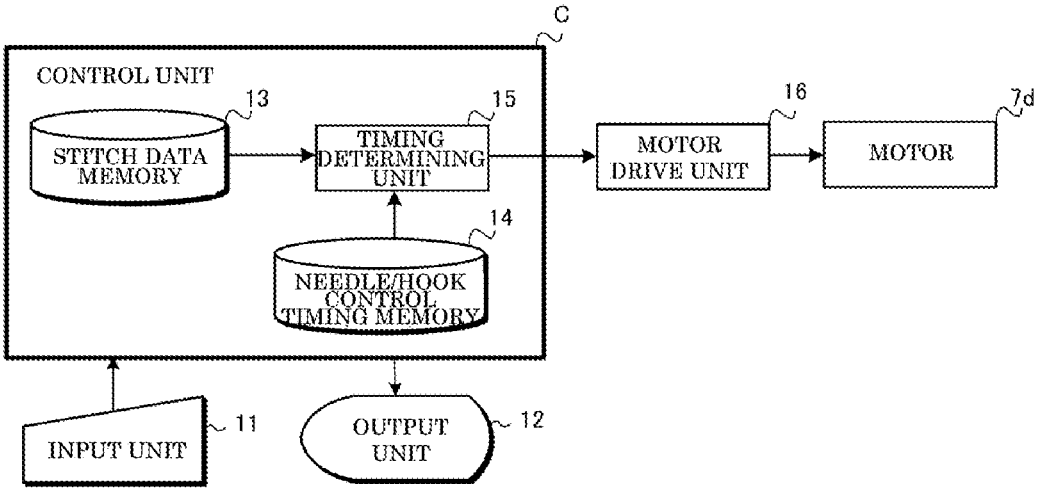
FIG. 2 is a functional block diagram illustrating an example structure of a control unit C of the first embodiment.

The control unit C controls the hook release phase, at which the hook releases the upper thread, in such a way that the hook/upper-thread necessary amount becomes smaller than the thread-take-up-lever/upper-thread supply amount. The control unit C employs plural timings of changing the hook release phase. FIG. 2 is a functional block diagram illustrating a structure of the control unit C. More specifically, the control unit C is constructed by a computer or an exclusive electric circuit which includes a CPU, a memory, etc., connected with an input unit 11 and an output unit 12, and which is operated in accordance with a predetermined program. In this case, the program physically utilizes the hardware resources of the computer, etc., thereby executing the processes to be explained below.

A method of executing each process explained below, a program, and a recording medium having stored therein the program are also aspects of this embodiment. In addition, how to set a range processed by hardware resources and a range processed by software resources that include the program is not limited to any particular way. For example, any one of the following units may be constructed as a circuit that executes each process.

In this embodiment, the control unit C controls the timing at which the idler unit 7 that is the belt adjusting mechanism changes the belt length at the tensioned side A. The control unit C includes a stitch data memory 13, a needle/hook control timing memory 14, and a timing determining unit 15. In addition, the control unit C is connected with a motor drive unit 16 that drives the motor 7*d* in accordance with a control signal from the timing determining unit 15.

The input unit 11 includes an input device that receives inputting of information by an operator, and an interface that notifies the control unit C of the input information. For example, the input unit 11 is input device for the operator to input an operation request and a change in set values to the sewing machine. Example input devices are operation buttons of the sewing machine, and a touch panel (including the touch panel placed on the display device of the output unit 12).

The output unit 12 includes an interface that outputs information from the control unit C, and the display that displays, in accordance with the output information, screens for the operator to check and select the details of operation. The output unit 12 is to, for example, indicate an operation setting for the sewing machine, and display an alert for an operation given by the operator. An example display device is a display that includes a display screen like a liquid crystal display panel.

The stitch data memory 13 stores pieces of stitch data corresponding to various stitch patterns including zig-zag stitches. Arbitrary stitch data can be selected through an operation button of the input unit 11. In addition, the output unit 12 may display pieces of stitch data upon operation given to the operation button of the input unit 11 to enable the operator to select the stitch data. The stitch data selected by the operator is input to the timing determining unit 15.

The needle/hook control timing memory 14 stores plural timings of swinging the idler unit 7 relative to the swing of the needle bar 1. Hence, in this embodiment, a timing at which the idler unit 7 changes the belt length at the tensioned side A, i.e., the needle/hook control timing is changeable.

That is, as a timing at which the idler unit 7 is moved to shorten the belt length at the tensioned side A and to retard the phase of the hook, a timing after the hook release phase may be applied, and as a timing at which the idler unit 7 is moved to elongate the belt length at the tensioned side A and to advance the phase of the hook, a timing before the hook release phase may be applied. The needle/hook control timing memory 14 also stores a constant timing of swinging the idler unit 7 in synchronization with, for example, the swing of the needle bar 1 by the swing mechanism 5.

The timing determining unit 15 determines the timing of swinging the idler unit 7 based on the stitch data input from the stitch data memory 13. The timing determining unit 15 reads the determined timing from the needle/hook control timing memory 14, and outputs the read timing to the motor drive unit 16. When, for example, the width of zig-zag sewing in the input stitch data is the maximum, the timing determining unit 15 outputs the control signal to the motor drive unit 16 so as to control the idler unit 7 at plural needle/hook control timings. This is because when the width of zig-zag sewing is the maximum and the hook release phase comes at a timing at which the hook is retarded, the hook/upper-thread necessary amount exceeds the thread-take-up-lever/upper-thread supply amount, causing an abnormal noise or a thread breakage.

When there is no possibility that, in the input stitch data, the hook/upper-thread necessary amount exceeds the thread-take-up-lever/upper-thread supply amount, the timing determining unit 15 determines a constant timing of, for example, swinging the idler unit 7 in synchronization with the needle bar 1. The timing determining unit 15 outputs the determined timing to the motor drive unit 16. The motor drive unit 16 controls the motor 7*d* in accordance with a control signal from the timing determining unit 15.

[1.2 Operation]

An example operation of the above-explained sewing machine will now be explained.

(1) Stitch Formation

With the upper thread inserted in the needle hole 1*a* of the needle 1*b*, and the bobbin around which the lower thread is wound being retained in the inner hook, when the upper shaft 3 is driven, stitches are formed. More specifically, when the upper shaft 3 is driven by the sewing machine motor, the crank mechanism converts the rotation of the upper shaft 3 into a reciprocal motion, and thus the needle bar 1 and the thread take-up lever 8 are moved up and down. In addition, the rotation of the upper shaft 3 is transferred to the lower shaft 4 through the upper-shaft pulley 3*a*, the toothed belt 6, and the lower-shaft pulley 4*a*. When the lower shaft 4 is rotated by the rotation of the upper shaft 3, the hook is rotated.

In such operations, the needle 1*b* passes completely through a cloth, and reaches a needle bottom dead center. When the needle 1*b* is raised to some level, the upper thread cannot be pulled out to the top face of the cloth due to a friction therewith, and thus a thread loop is formed below the cloth. When the tip 2*a* of the outer hook 2 passes through the thread loop, the bobbin around which the lower thread is wound passes through the thread loop, and the upper thread and the lower thread are intertwined with each other, and thus a stitch is formed.

(2) Thread Loop Formation

Figure 3:
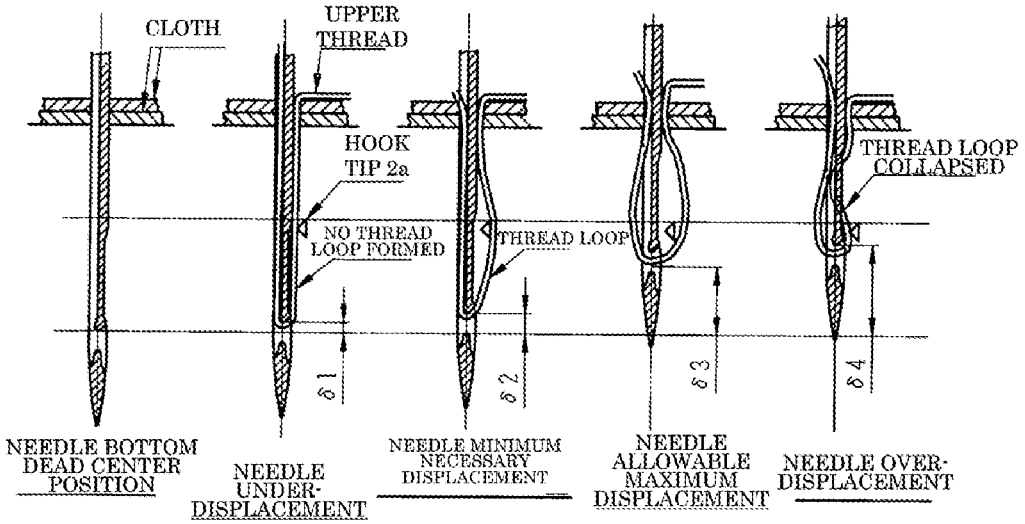
FIG. 3 is an explanatory diagram illustrating how a needle and a hook tip form a stitch.

The size of the thread loop depends on the level of the needle 1*b* is raised from the bottom dead center. In FIG. 3, the raised level of the needle 1*b* from the bottom dead center is indicated as a needle displacement δ. δ1 indicates an under-displacement of the needle 1*b*. When the displacement of the needle 1*b* is too small like δ1, it is difficult to form a thread loop, or even if the thread loop can be formed, the thread loop is too small, and the tip 2*a* cannot enter the thread loop. Conversely, δ4 indicates an over-displacement of the needle 1*b*. When the displacement of the needle 1*b* is too large like δ4, the thread loop becomes too large, and is collapsed by the self-weight of the thread or by twisting, and thus the tip 2*a* cannot enter the thread loop. As explained above, if the needle displacement is too small or too large, it is difficult to form a stitch.

Hence, in order to form an appropriate stitch, the needle displacement should be set so as to enable the formation of the thread loop and to cause the tip 2*a* of the hook 2 to enter the thread loop. In FIG. 3, a necessary minimum displacement is indicated as δ2, and an allowable maximum displacement is indicated as δ3. In order to form an appropriate stitch, it is necessary to set the needle displacement to be equal to or larger than δ2 but equal to or smaller than δ3.

Figure 4:
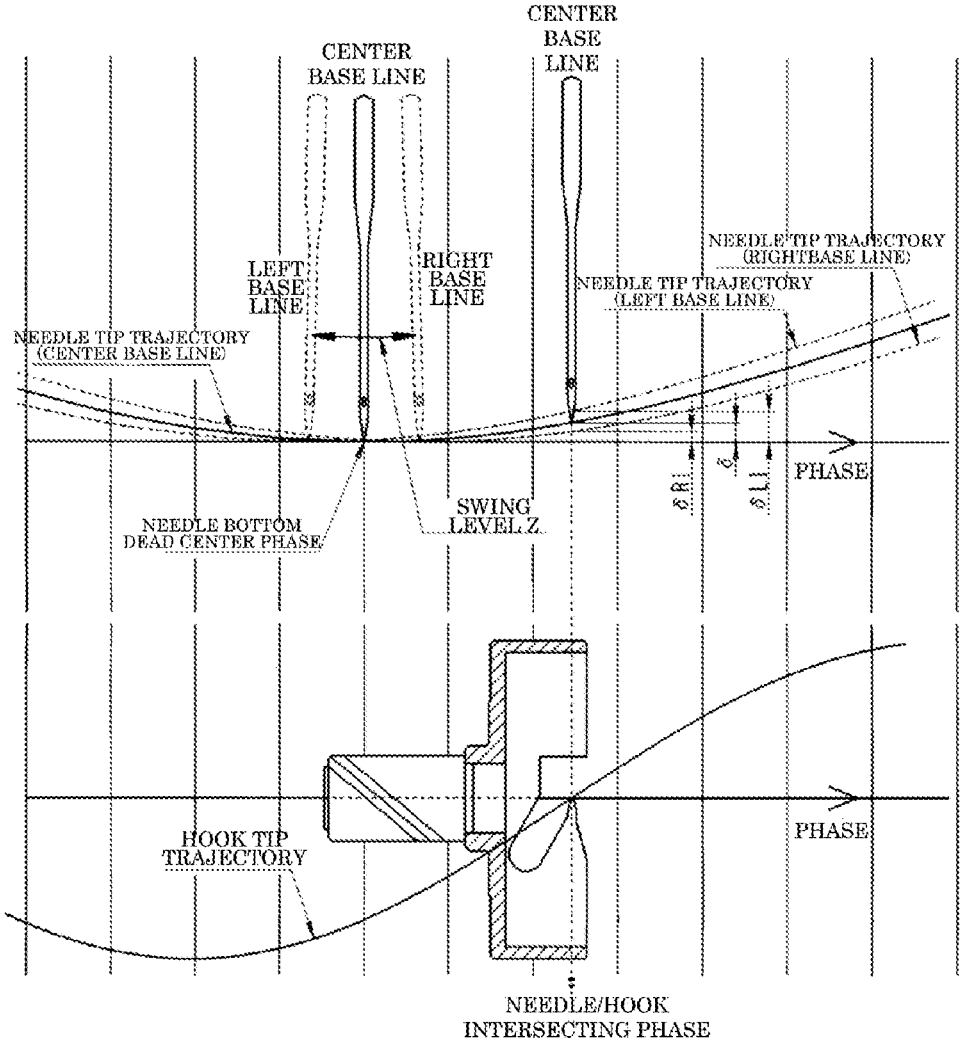
FIG. 4 is an explanatory diagram illustrating a change in the position of the needle, and a change in a relative operation between the needle and the hook tip in accordance with the change in the needle position.

(3) Trajectory of Needle at the Time of Zig-Zag Sewing in Conventional Sewing Machines The swing mechanism 5 swings the needle bar 1 by the drive force from the swing motor 5*a* so as to intersect with the cloth feeding direction, zig-zag stitches are formed. FIG. 4 illustrates, in conventional sewing machines, a change in the relative operation of the needle 1*b* and the tip 2*a* of the hook 2 when zig-zag sewing is performed. The horizontal axis in FIG. 4 represents the phases of the upper shaft 3 and the lower shaft 4, while the vertical axis represents the simulated trajectories of the tip of the needle 1*b* and the tip 2*a* of the hook 2. The trajectory of the tip 2*a* is slightly different from an actual trajectory, but is illustrated with a continuous line for the purpose of explanation. In the example in FIG. 4, it is presumed that the hook rotates in a counterclockwise direction.

In FIG. 4, the needle 1*b* and the trajectory illustrated by thick lines indicate that the swing mechanism 5 is not actuated and the needle 1*b* is located at a center base line that is the center. In addition, the needle 1*b* and the trajectory illustrated by dashed lines indicate that the needle 1*b* swings from side to side by the swing mechanism 5. At the needle/hook intersecting phase in the figure, the needle 1*b* and the tip 2*a* are coming close to each other maximally. In such a needle/hook intersecting phase, the tip 2*a* enters the thread loop of the upper thread.

As explained above, in order to form a stitch, it is necessary to set the needle displacement to be equal to or larger than the necessary minimum displacement δ2 but equal to or smaller than allowable maximum displacement δ3. At the time of zig-zag sewing, however, the position of the hook 2 is constant, but the needle 1*b* swings from side to side from the center base line, and thus the relative position of the needle 1*b* to the hook 2 changes. A change in the positional relationship affects the needle displacement.

When, for example, in conventional sewing machines, representing the needle displacement when the needle 1*b* is moved to the right as δR1, δR1 is smaller than the needle displacement δ in the center-base-line condition. In addition, representing the needle displacement when the needle 1*b* is moved to the left as δL1, δL1 becomes larger than the needle displacement δ in the center-base-line condition. That is, even if the needle displacement δ in the center-base-line condition is set to be an appropriate value, when the needle 1*b* swings from side to side, δR1 becomes smaller than the minimum necessary displacement δ2 or δL1 becomes larger than the allowable maximum displacement δ3, and thus it sometime becomes difficult to form an appropriate thread loop.

A change in the needle displacement due to a position change of the needle 1*b* increases in proportional to a swing level Z of the needle 1*b* which swings side to side. Hence, according to conventional sewing machines, a stitch can be formed only when the needle displacement satisfies a condition $\delta 2<\delta R1<\delta<\delta L1<\delta 3$. Accordingly, the maximum swing level Z is automatically determined. Hence, even if there is a need for sewing of a pattern that needs a larger swing than the automatically determined value, it is technically difficult to meet such a need.

Figure 5:
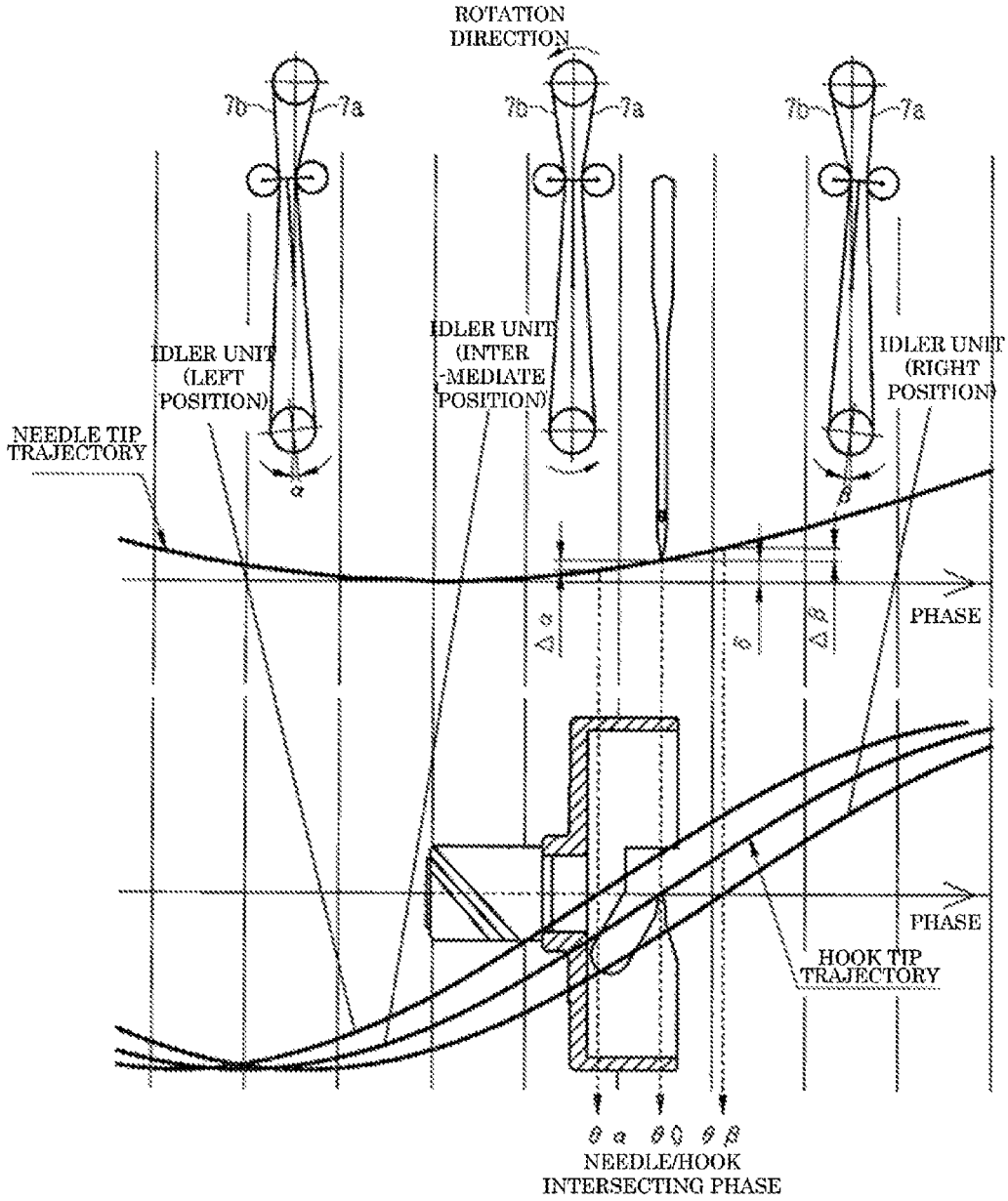
FIG. 5 is an explanatory diagram illustrating a change in the position of an idler unit, and a change in a relative operation between the needle and the hook tip in accordance with the change in the idler unit position.

(4) Change in Relative Operation of Needle to Hook when Belt Adjusting Mechanism is Applied The belt adjusting mechanism corrects the needle displacement by changing the belt length of the toothed belt 6 at the tensioned side A. FIG. 5 illustrates a change in the relative operation of the needle 1*b* to the tip 2*a* of the hook 2 when the idler unit 7 that is the belt adjusting mechanism is moved. The horizontal axis of FIG. 5 represents the phases of the upper shaft 3 and the lower shaft 4, while the vertical axis represents the simulated trajectories of the tip of the needle 1*b* and the tip 2*a* of the hook 2. The trajectory of the tip 2*a* is slightly different from an actual trajectory, but is indicated by a continuous line for the purpose of explanation. In the example case in FIG. 5, it is presumed that the hook 2 rotates counterclockwise.

FIG. 5 illustrates respective changes in the hook-tip trajectory when the idler unit 7 is located at the center position, the left position, and the right position. In the needle/hook intersecting phase in the figure, the needle 1*b* and the tip 2*a* are coming close to each other maximally. In this needle/hook intersecting phase, the tip 2*a* enters the thread loop of the upper thread. When the idler unit 7 is moved, the motion trajectory of the tip 2*a* of the hook 2 changes. Hence, the needle/hook intersecting phase also changes, and thus the raised level of the needle and the needle displacement both in the needle/hook intersecting phase change. In this case, it is presumed that the needle/hook intersecting phase when the idler unit 7 is located at the center position is θ0, and the needle displacement in this case is δ.

When, for example, the idler unit 7 is moved to the left, i.e., when the idler unit 7 is moved in a direction in which the idler 7*a* pushes the tensioned side A of the toothed belt 6, the length of the toothed belt 6 at the tensioned side A becomes long. When the length at the tensioned side A becomes long, in comparison with a case in which the idler unit 7 is located at the center position, a phase difference α is produced between the upper shaft 3 an the lower shaft 4, the needle/hook intersecting phase is changed to a position that is θα, and the needle displacement decreases by Δα relative to δ.

In addition, when the idler unit 7 is moved to the right, i.e., when the idler unit 7 is moved in a direction in which the idler 7*b* pushes the loosened side B of the toothed belt 6, the length of the tensioned side A of the toothed belt 6 becomes short. When the length at the tensioned side A becomes short, in comparison with a case in which the idler unit 7 is located at the center portion, a phase difference β is produced between the upper shaft 3 and the lower shaft 4, the needle/hook intersecting phase is changed to a position that is θβ, and the needle displacement increases by Δβ relative to δ.

The increase/decrease in the needle displacement δ due to the movement of the idler unit 7 is determined based on the position of the idler unit 7 regardless of the movement of the needle bar 1 by the swing mechanism 5. Hence, by swinging the idler unit 7, a decrease by Δα or an increase by Δβ can be arbitrarily given to the needle displacement δ.

As explained above, in conventional sewing machines, it is necessary to set the maximum value of the swing level Z to satisfy, for the needle displacement that changes in proportional to the swing level Z, a condition $\delta 2<\delta R1<\delta<\delta L1<\delta 3$. Conversely, according to the advantageous effects of the sewing machine of this embodiment, an increase/decrease in the needle displacement by the movement of the idler unit 7 can be determined based on the position of the idler unit 7 regardless of the movement of the needle bar 1 by the swing mechanism 5. Hence, when a setting is made so as to cancel the increase/decrease in the needle displacement by the movement of the needle bar 1 by the increase/decrease in the needle displacement by the movement of the idler unit 7, a condition $\delta 2<(\delta R2+\Delta\beta)<\delta<(\delta L2-\Delta\alpha)<\delta 3$ is satisfied. In this case, δR2 is a needle displacement when the needle bar 1 swings maximally to the right in the sewing machine of this embodiment. Also, δL2 is a needle displacement when the needle bar 1 swings maximally to the left in the sewing machine of this embodiment.

When the needle displacement at the time of maximum swing to the right/left is compared between conventional sewing machines and the sewing machine of this embodiment, $\delta R1=\delta R2+\Delta\beta$, and $\delta L1=\delta L2-\Delta\alpha$ are satisfied. δR2 can be reduced by Δβ relative to δR1, while δL2 can be increased by Δα relative to δL1. In this case, a difference between the needle displacement when the needle falls at the right side and the needle displacement when the needle falls at the left side is proportional to the swing level Z, i.e., according to the sewing machine of this embodiment, the maximum value of the swing level Z can be set larger than that of conventional sewing machines.

Control of Idler Unit 7 by Control Unit C

First, prior to the explanation for a control by the control unit C, a detailed explanation will be given to a relationship between the hook/upper-thread necessary amount and the thread-take-up-lever/upper-thread supply amount in plural sewing conditions.

(a) Straight Sewing at Center Base Line

Figure 6:
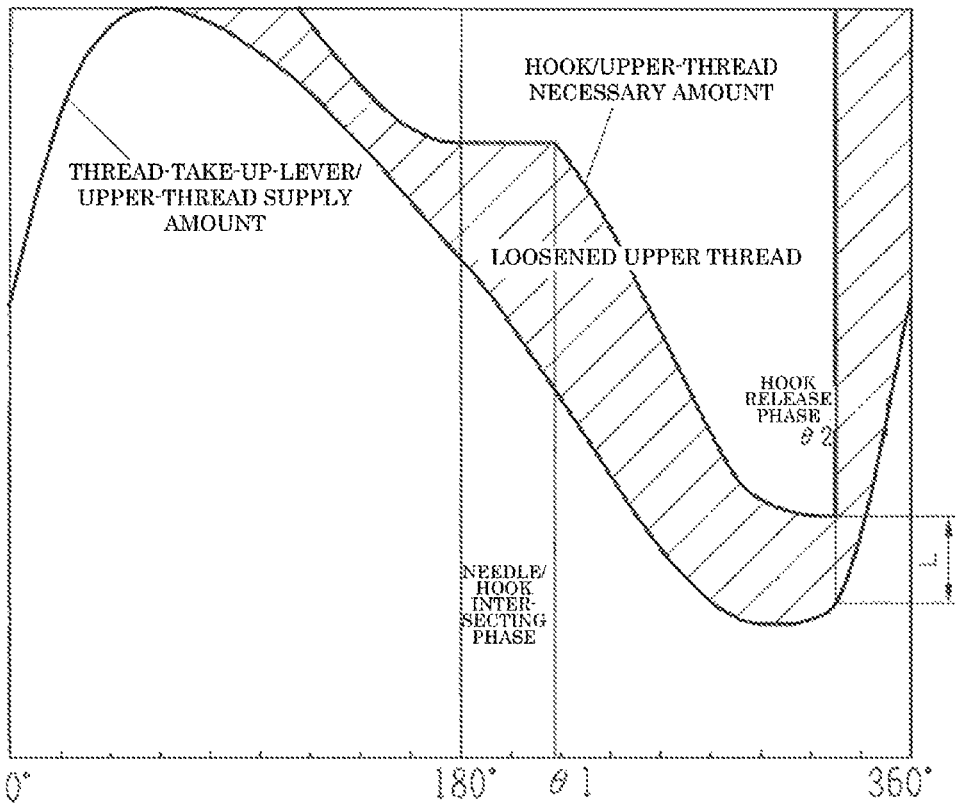
FIG. 6 is an operation diagrammatic drawing indicating a change in a loosened upper thread caused by the operation of a thread take-up lever and that of the hook when straight sewing is performed without a needle/hook intersecting phase control.

FIG. 6 illustrates a relationship between the hook/upper-thread necessary amount and the thread-take-up-lever/upper-thread supply amount in a case of straight sewing. The vertical axis represents an amount of thread that increases as coming close to the origin. In addition, the horizontal axis represents a phase. The thread-take-up-lever/upper-thread supply amount that is supplied larger than the hook/upper-thread necessary amount is indicated by hatching in the figure as the loosened upper thread. In this graph, the tip 2*a* catches the upper thread at the needle/hook intersecting phase, and the upper thread goes through the inner hook at the hook release phase.

It is not illustrated in FIG. 6, but the needle 1*b* moves up and down that has a motion trajectory of passing through the top dead center at the phase of 0 degree, and also passing through the bottom dead center at the phase of 180 degrees. At a needle/hook intersecting phase θ1 subsequent to the bottom dead center, the needle 1*b* passes completely through a cloth and forms a thread loop of the upper thread below the cloth, and, this thread loop is caught by the tip 2*a*. In this case, in conjunction with the operation of the hook, the caught upper thread goes through the inner hook that retains therein the lower thread. At this time, the upper thread temporarily needs a length by what corresponds to the portion of the upper thread that goes through the inner hook. Hence, after the needle/hook intersecting phase θ1, the hook/upper-thread necessary amount gradually increases, and becomes the maximum right before a hook release phase θ2 where the inner hook releases the upper thread.

The thread take-up lever 8 goes down in accordance with the increasing hook/upper-thread necessary amount. Hence, the thread-take-up-lever/upper-thread supply amount gradually increases. Accordingly, the operation of the thread take-up lever 8 supplies the hook/upper-thread necessary mount at the hook release phase θ2, and thus a sufficient loosened upper thread L is maintained. The thread-take-up-lever/upper-thread supply amount becomes the maximum right before the hook release phase θ2, but after the hook release phase θ2 at which the upper thread goes through the hook, the hook/upper-thread necessary amount remarkably decreases. Accordingly, the loosened upper thread increases rapidly.

Conversely, the thread take-up lever 8 changes its operation to an operation of collecting the upper thread, and thus the loosened upper thread that has rapidly increased is quickly decreased. Through the above-explained successive operations, a sewing operation is performed while maintaining the certain loosened upper thread. When the loosened upper thread becomes insufficient, it causes a thread breakage, but when the loosened upper thread increases excessively, a thread breakage or a thread tightness failure is caused due to the excessive vibration of the thread and the snarl of the thread. Therefore, the loosened upper thread should be increased or decreased only in accordance with a need.

(b) Straight Sewing with Needle/Hook Intersecting Phase Control

Figure 7:
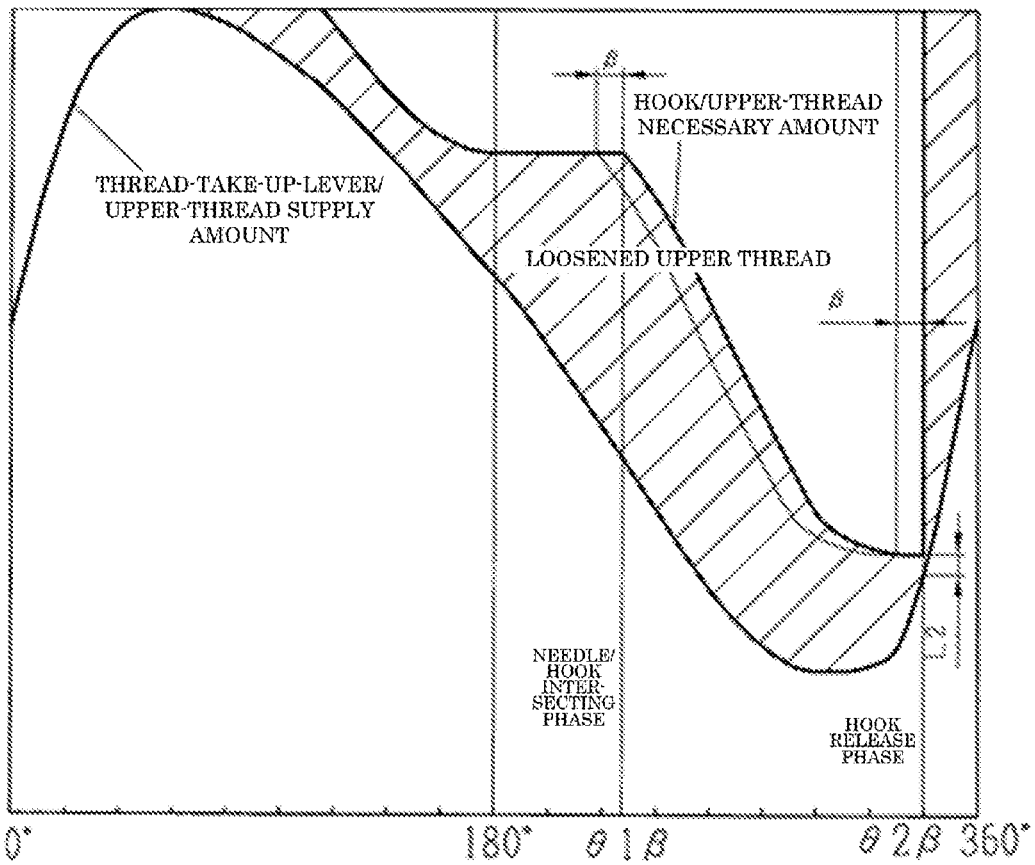
FIG. 7 is an operation diagrammatic drawing illustrating a change in the loosened upper thread caused by the operation of the thread take-up lever and that of the hook when straight sewing is performed at a right base line position where a needle/hook intersecting phase is controlled by a phase difference β.

When, for example, the needle 1*b* is moved to a right base line from the center base line, and a change in the needle displacement due to the movement of the needle 1*b* is corrected by a needle/hook intersecting phase control that moves the idler unit 7, as explained above, the idler unit 7 is moved in the direction in which the idler 7*b* pushes the loosened side B, and thus the length of the toothed belt 6 at the tensioned side A becomes short. When the length at the tensioned side A becomes short, the needle/hook intersecting phase is controlled by a phase difference β. Hence, as illustrated in FIG. 7, in comparison with the hook release phase θ1, a hook release phase θ1β is retarded by the phase difference β, and a loosened upper thread L2 at the hook release phase becomes shorter than L. In this case, however, the loosened upper thread is not insufficient.

(c) Zig-Zag Sewing without Needle/Hook Intersecting Phase Control

Figure 8:
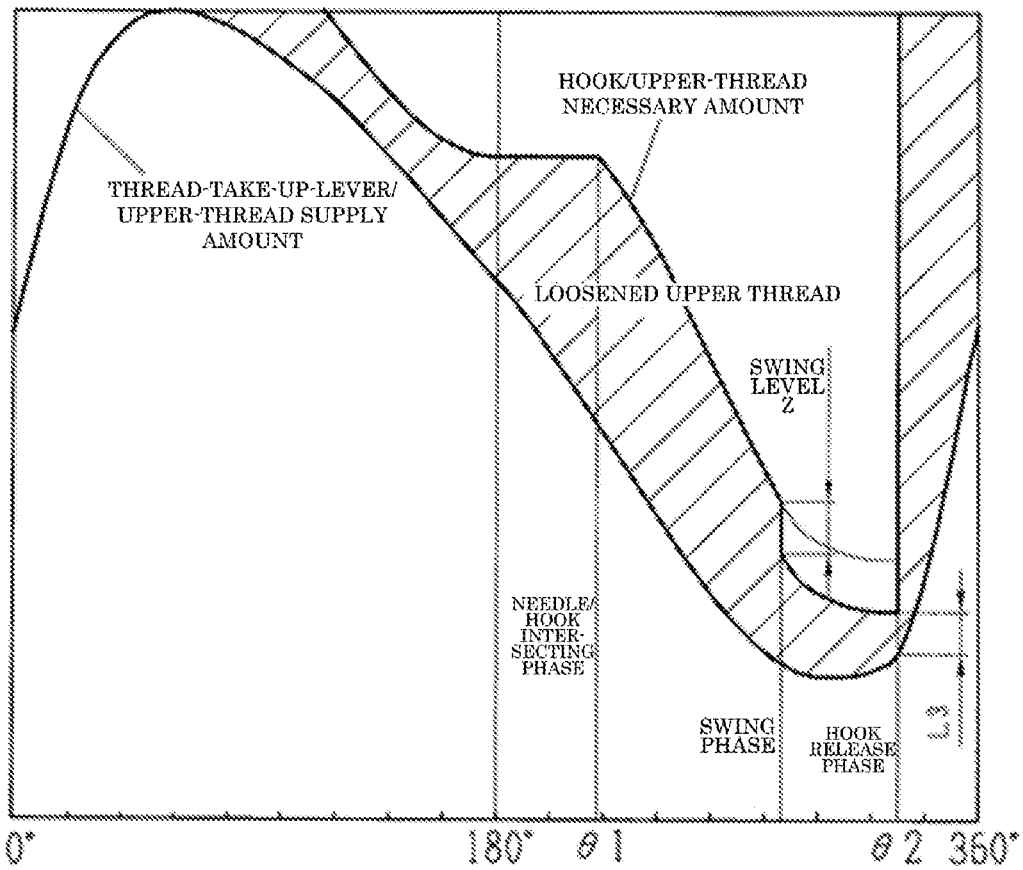
FIG. 8 is an operation diagrammatic drawing illustrating a change in the loosened upper thread caused by the operation of the thread take-up lever and that of the hook when zig-zag sewing is performed without the needle/hook intersecting phase control.

As explained above, when zig-zag sewing is performed, the needle bar 1 swings and moves from side to side in a swing phase while the outer hook 2 is catching the upper thread. That is, the upper thread inserted in the needle hole of the needle 1*b* moves from side to side. Hence, as illustrated in FIG. 8, the hook/upper-thread necessary amount increases by what corresponds to the swing level Z of the needle 1*b*. In this case, however, the hook/upper-thread necessary amount at the hook release phase θ2 can be supplied by the operation of the thread take-up lever 8, and thus a sufficient loosened upper thread L3 is maintained.

(d) Zig-Zag Sewing with Needle/Hook Intersecting Phase Control

As explained above, the setting is made, in any conditions, such as straight sewing and zig-zag sewing at a constant swing level, so that the loosened upper thread does not become insufficient although the loosened upper thread decreases. Conversely, according to a sewing machine disclosed in JP 2008-264500 A which can set the maximum value of the swing level Z to be further large through a needle/hook intersecting phase control, the retard of a hook release phase θ2β by the control of the needle/hook intersecting phase θ1β illustrated in FIG. 7, and the decrease in the loosened upper thread at the hook release phase θ2 originating from zig-zag sewing illustrated in FIG. 8 may simultaneously occur.

Figure 9:
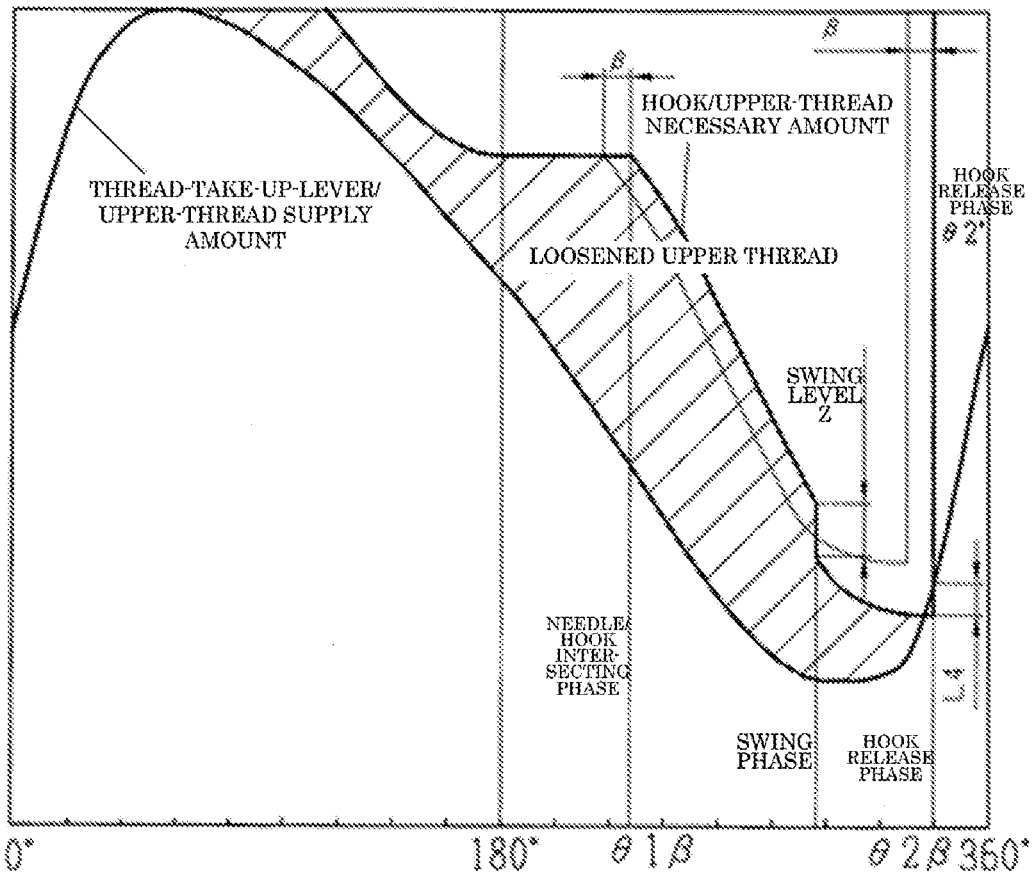
FIG. 9 is an operation diagrammatic drawing illustrating a change in the loosened upper thread caused by the operation of the thread take-up lever and that of the hook when zig-zag sewing is performed and the needle/hook intersecting phase is controlled by the phase difference β.

As illustrated in FIG. 9, with the timing of the hook being retarded in zig-zag sewing employing a needle/hook intersecting phase control, if the phase progresses beyond the hook release phase θ2β while the loosened upper thread is reduced by the swing of the needle 1*b*, the hook/upper-thread necessary amount exceeds the thread-take-up-lever/upper-thread supply amount by what corresponds to a loosened upper thread L4. That is, a condition in which L4<0 occurs, and the loosened upper thread becomes insufficient during sewing, causing a thread breakage or an abnormal noise.

Figure 10:
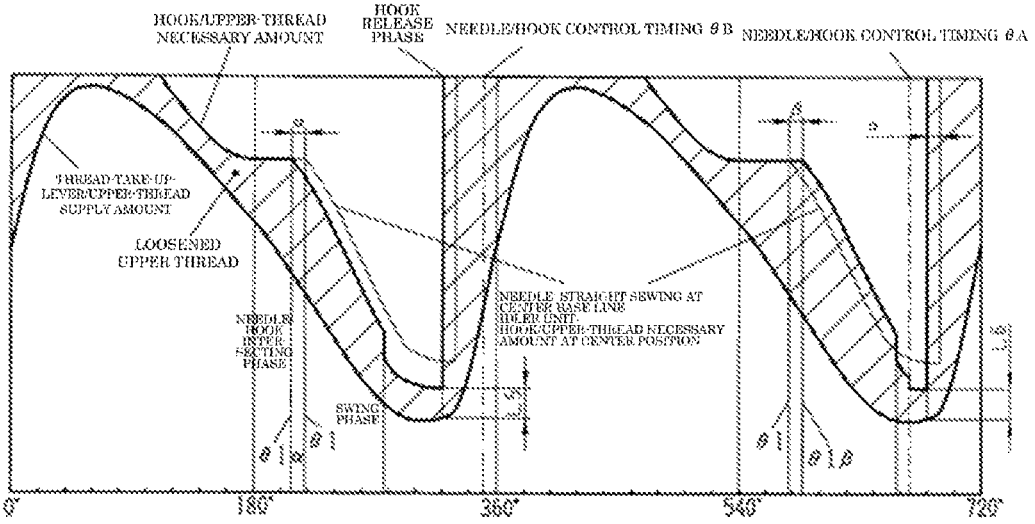
FIG. 10 is an operation diagrammatic drawing illustrating a change in the upper thread caused by the operation of the thread take-up lever and that of the hook when the present invention is applied to the case in FIG. 9.

According to the sewing machine of this embodiment, however, when, for example, stitch data is input which has a possibility that the loosened upper thread becomes insufficient, such as the needle falling at the right side in zig-zag sewing which needs a needle/hook control and which has the swing level Z that is equal to or larger than a certain value, the control unit C controls the timing of changing the hook release phase in such a way that the hook/upper-thread necessary amount becomes smaller than the thread-take-up-lever/upper-thread supply amount. That is, the control unit C controls and changes a timing at which the idler unit 7 changes the belt length at the tensioned side A. FIG. 10 illustrates an example case in which needle/hook control timings θA, θB before and after the hook release phase are changed to control the hook release phase, thereby preventing the loosened upper thread from being insufficient.

FIG. 10 is a diagram illustrating a relationship between the thread-take-up-lever/upper-thread supply amount and the hook/upper-thread necessary amount when zig-zag sewing is assumed. The first cycle (0 to 360 degrees) indicates a needle falling at the left side, and the second cycle (360 to 720 degrees) indicates a needle falling at the right side. By repeating the first cycle and the second cycle alternately, zig-zag stitches can be formed. In this case, the control unit C performs a needle/hook control at different phases which are the needle/hook control timing θA and the needle/hook control timing θB before and after the hook release phase, thereby controlling the hook release phase.

According to this embodiment, in the second cycle, a needle/hook control is performed which moves the idler unit 7 in a direction in which the loosened side A is pushed at the timing θA that is before the hook release phase, and which advances the phase of the hook. Hence, the hook release phase in the second cycle is advanced by what corresponds to an addition of phase differences α and β in comparison with a case in which a control is performed so as to retard the phase by β. Accordingly, the hook/upper-thread necessary amount becomes smaller than the thread-take-up-lever/upper-thread supply amount, and a sufficient loosened upper thread L6 is ensured. Therefore, unlike the loosened upper thread L4 in FIG. 9 which is caused when the swing is increased and a needle/hook control is performed, an abnormal noise or a thread breakage originating from abnormal tension applied to the upper thread due to insufficient loosened upper thread can be prevented.

[1.3 Effects of Embodiment]

The sewing machine of this embodiment which employs the above-explained structure can accomplish the following advantageous effects.

(1) The control unit C controls the hook release phase in such a way that the hook/upper-thread necessary amount becomes smaller than the thread-take-up-lever/upper-thread supply amount. The control unit C controls the hook release phase at plural timings. Hence, when an operation is performed in which the hook/upper-thread necessary amount exceeds the thread-take-up-lever/upper-thread supply amount, a needle/hook control timing can be changed. Accordingly, a sufficient loosened upper thread can be ensured. Therefore, an occurrence of a thread breakage or an abnormal noise can be prevented.

(2) The control unit C controls the phase of the hook so as to be advanced at a timing before the hook release phase. When the width of zig-zag sewing is the maximum and the hook release phase comes while the phase of the hook is being retarded, the hook/upper-thread necessary amount exceeds the thread-take-up-lever/upper-thread supply amount, but through the control by the control unit C, the phase of the hook is advanced at a timing before the hook release phase. Accordingly, a sufficient loosened upper thread can be ensured, thereby preventing an occurrence of a thread breakage or an abnormal noise.

(3) The sewing machine is provided with the idler unit 7 which is the belt adjusting mechanism and which changes the belt length of the toothed belt 6 at the tensioned side A. Hence, a timing of the needle 1*b* and that of the hook can be controlled as needed. Therefore, a difference in timing between the needle and the hook which is caused by the swing of the needle bar can be stably controlled, and a sufficient loosened upper thread can be ensured.

2. Other Embodiments

The present invention is not limited to the above-explained embodiment, and various changes can be made thereto as needed.

(1) According to the above-explained embodiment, the belt adjusting mechanism is constructed by the idler unit 7 that includes the two idlers 7*a*, 7*b* which contact the tensioned side A of the tooled belt 6 and the loosened side B thereof, respectively. However, the structure including the two idlers is employed in view of the safeness, and it is appropriate if at least one idler is provided at the tensioned side A of the toothed belt 6. According to this structure, the number of parts can be reduced, and the same advantageous effects as those of the above-explained embodiment can be still accomplished.

According to the above-explained embodiment, when, for example, stitch data is input which has a possibility that the loosened upper thread becomes insufficient, such as the needle falling at the right side in zig-zag sewing which needs a needle/hook control and which has the swing level Z that is equal to or larger than a certain value, the control unit C controls the timing of changing the hook release phase in such a way that the hook/upper-thread necessary amount becomes smaller than the thread-take-up-lever/upper-thread supply amount. However, a simpler control method which is carried out before the hook release phase in the case of, for example, a control of advancing the hook release phase, and is carried out after the hook release phase in the case of a control of retarding the hook release phase can also accomplish the same advantageous effects as those of the above-explained embodiment.

(3) The embodiments of the present invention were explained above, but various omissions, replacements, and modifications can be made without departing from the scope of the present invention. Such embodiments and modified embodiments thereof are within the scope of the present invention, are also within the scope of the invention as recited in appended claims and within the equivalent range thereto.

What is claimed is:

1. A sewing machine comprising:

a thread take-up lever supplying an upper thread to a needle from a thread supply source;

a hook catching the upper thread inserted in the needle, and intertwining the upper thread with a lower thread;

a rotatable upper shaft driving a needle bar that supports the needle, and the thread take-up lever;

a rotatable lower shaft driving the hook;

an upper-shaft pulley provided at the upper shaft;

a lower-shaft pulley provided at the lower shaft;

a belt coupling the upper-shaft pulley and the lower-shaft pulley and synchronizing respective rotations;

a belt adjusting mechanism contacting the belt and changing a belt length at a tensioned side where the belt is drawn in; and a control unit controlling a hook release phase, at which the hook releases the upper thread, in such a way that a hook/upper-thread necessary amount that is an upper thread length being required when the upper thread goes around an inner hook in which the lower thread is retained and corresponding to an outer circumference of the inner hook becomes smaller than a thread-take-up-lever/upper-thread supply amount that is supplied by an operation of the thread take-up lever, wherein the control unit controls and changes a timing at which the belt adjusting mechanism changes the belt length at the tensioned side and controls the hook release phase at a plurality of timings.

2. The sewing machine according to claim 1, wherein the control unit controls, at a timing before the hook release phase, the hook release phase so as to advance the hook release phase.

3. The sewing machine according to claim 1, wherein:

the belt adjusting mechanism comprises at least one idler contacting the belt at the tensioned side; and the belt length at the tensioned side is changed by swinging the idler.

4. A control method of a sewing machine comprising a thread take-up lever supplying an upper thread to a needle from a thread supply source, a hook catching the upper thread inserted in the needle, and intertwining the upper thread with a lower thread, a rotatable upper shaft driving a needle bar that supports the needle, and the thread take-up lever, a rotatable lower shaft driving the hook, an upper-shaft pulley provided at the upper shaft, a lower-shaft pulley provided at the lower shaft, a belt coupling the upper-shaft pulley and the lower-shaft pulley and synchronizing respective rotations, and a belt adjusting mechanism contacting the belt and changing a belt length at a tensioned side where the belt is drawn in, the method comprising:

controlling and changing a timing at which the belt adjusting mechanism changes the belt length at the tensioned side and controlling, at a plurality of timings, a hook release phase at which the hook releases the upper thread in such a way that a hook/upper-thread necessary amount that is an upper thread length being required when the upper thread goes around an inner hook in which the lower thread is retained and corresponding to an outer circumference of the inner hook becomes smaller than a thread-take-up-lever/upper-thread supply amount that is supplied by an operation of a thread take-up lever.

* * * * *